US006917770B2

(12) United States Patent
Bae et al.

(10) Patent No.: US 6,917,770 B2
(45) Date of Patent: Jul. 12, 2005

(54) CHARGING VOLTAGE CONTROLLER OF IMAGE FORMING APPARATUS

(75) Inventors: Byoung-chul Bae, Suwon (KR); Ui-choon Lee, Suwon (KR); Su-jong Jeong, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 58 days.

(21) Appl. No.: 10/600,651

(22) Filed: Jun. 23, 2003

(65) Prior Publication Data

US 2004/0005156 A1 Jan. 8, 2004

(30) Foreign Application Priority Data

Jul. 3, 2002 (KR) ..... 2002-38469

(51) Int. Cl.[7] ..... G03G 15/02
(52) U.S. Cl. ..... 399/44; 399/50; 399/176
(58) Field of Search ..... 399/44, 50, 174, 399/175, 176

(56) References Cited

U.S. PATENT DOCUMENTS 5,132,869 A * 7/1992 Nakaya ..... 361/233
6,615,002 B2 * 9/2003 Saito et al. ..... 399/43
6,640,063 B2 * 10/2003 Adachi et al. ..... 399/50

* cited by examiner

*Primary Examiner*—Hoang Ngo
(74) *Attorney, Agent, or Firm*—Staas & Halsey LLP

(57) ABSTRACT

A charging voltage controller of an image forming apparatus includes a charging roller charging a photoconductive drum with a predetermined charging voltage, a high voltage supply unit supplying the predetermined charging voltage to the charging roller, an electric current detecting unit detecting an electrical current flowing the charging roller, and a control unit supplying first and second test voltages of different degrees to the charging roller, determining a first reference voltage to be applied to the charging roller based on data from the electric]current detecting unit outputted in response to the first test voltage, calculating slope data based on the electrical current data detected from the electric current detecting unit in response to the first and second test voltages, and determining the charging voltage to be applied to the charging roller as a sum of the first reference voltage and a preset offset voltage that corresponds to the slope data.

14 Claims, 3 Drawing Sheets

CHARGING VOLTAGE CONTROLLER OF IMAGE FORMING APPARATUS

CROSS-REFERENCE TO RELATED APPLICATIONS

This application claims the benefit of Korean Application No. 2002-38469, filed Jul. 3, 2002, in the Korean Intellectual Property Office, the disclosure of which is incorporated herein by reference.

BACKGROUND OF THE INVENTION

1. Field of the Invention

The present invention relates to a charging voltage controller of an image forming apparatus, and more particularly, to a charging voltage controller of an image forming apparatus capable of compensating for a change of a surface electrical potential on a photoconductive medium due to a variety of factors influencing a charging roller.

2. Description of the Related Art

Generally, an image forming apparatus, such as a duplicating machine, a printer, a facsimile, or a multifunction machine, for performing various functions has a printing function. The printer outputs information processed by a computer in a visible form.

FIG. 1 is a schematic cross-sectional view of a charging voltage controller of a conventional image forming apparatus.

Referring to FIG. 1, the image forming apparatus includes a control unit 10, an HVPS (High Voltage Power Supply) 20, a charging device 30, a photoconductive drum 40, a laser scanning device 50, a developer 60, and a transfer roller 70.

With a power supply, the control unit 10 outputs a controlling signal to drive each part of the image forming apparatus while simultaneously applying a pre-set voltage to each corresponding roller of the image forming apparatus.

The HVPS 20 applies a voltage corresponding to the controlling signal provided from the control unit 10 to a charging roller 30*a*, a developing roller 60*a* and the transfer roller 70, respectively.

The charging device 30 evenly charges a surface of the photoconductive drum 40 as the charging roller 30*a* is rotated while being charged with a higher voltage supplied from the HVPS 20. The laser scanning device 50 scans the photoconductive drum 40 with light in response to print data under control of the control unit 10.

The developer 60 develops an electrostatic latent image formed on the photoconductive drum 40 by the laser scanning device 50 with a developing agent having an electric charge using the developing roller 60*a* which is rotated while being charged with a developer voltage supplied from the HVPS 20.

The transfer roller 70 is rotated by the photoconductive drum 40 while being charged with a transcription voltage applied from the HVPS 20, and prints an image developed on the photoconductive drum 40 onto a sheet of paper being fed by a feeding unit (not shown). The image forming apparatus fuses the image printed on the paper by the transfer roller 70 through a fusing unit (not shown) and discharges the paper bearing the fixed image.

In a case that a printing process is performed by the image forming apparatus having the foregoing structure, if the charging potential of the photoconductive drum 40 is uneven, a density deviation occurs in the image printed on the paper, and a print image quality deteriorates.

That is, the surface electric potential of the photoconductive drum 40 can be changed due to an influence of environments (for example, temperature and humidity) where the image forming apparatus is used. Also, a film thickness of the photoconductive drum 40 becomes thinner as a result of a longer usage, thereby changing the surface electric potential. The change in the surface electric potential could deteriorate an image quality. Therefore, it is necessary to maintain a constant surface electric potential of the photoconductive drum 40 and prevent deterioration of the image quality.

SUMMARY OF THE INVENTION

An aspect of the invention is to solve at least the above and/or other problems and disadvantages and to provide at least one advantage described hereinafter.

Accordingly, one aspect of the present invention is to solve the foregoing and/or other problems by providing a charging voltage controller of an image forming apparatus capable of obtaining a uniform image quality by suppressing a change in a surface electric potential of a photoconductive medium occurring due to factors influencing a charged electric potential.

Additional aspects and advantages of the invention will be set forth in part in the description which follows and, in part, will be obvious from the description, or may be learned by practice of the invention.

The foregoing and/or other aspects and advantages are realized by a charging voltage controller of an image forming apparatus according to the present invention. The charging voltage controller of an image forming apparatus includes a charging roller charging a photoconductive drum with a predetermined charging voltage, a high voltage supply unit supplying the predetermined charging voltage to the charging roller, an electric current detecting unit detecting an electrical current flowing to the charging roller, and a control unit. The control unit supplies first and second test voltages of different levels to the charging roller, determining a first reference voltage to be applied to the charging roller based on data from the electric current detecting unit outputted in response to the first test voltage, calculates slope data based on the electrical current data detected from the electric current detecting unit in response to the first and second test voltages, and determines the charging voltage to be applied to the charging roller as a sum of the first reference voltage and a preset offset voltage that corresponds to the slope data.

The charging voltage controller further includes a storage unit storing a first lookup table and a second lookup table, wherein the first lookup table stores an environmental factor set in correspondence with the data outputted from the electric current detecting unit in response to the first and second test voltages, and the first reference voltage set in correspondence with the environmental factor, and the second lookup table stores offset voltage data set in correspondence with the slope data.

The controller supplies the high voltage supply unit with the first test voltage before supplying the second test voltage to the photoconductive medium.

The first test voltage is greater than the second test voltage.

The environment factors comprise one or a combination of humidity, temperature, a thickness, and a surface condition of the photoconductive medium.

The high voltage supply unit comprises: a transformer having a primary winding coupled between a potential and the controller, and a secondary winding having a first end coupled to the charging roller and a second end coupled to the current detecting unit; and a rectifying unit rectifying a voltage disposed on the secondary winding of the transformer.

The charging voltage controller further includes a pulse width modulating unit coupled between the controller and the primary winding to output a signal having a duty ratio according to a control signal of the controller; and a switching unit coupled between the pulse width modulating unit and the primary winding of the high voltage supply unit to supply the first and second test voltage, and the charging voltage to the high voltage supply unit according to the signal having the duty ratio.

The current detecting unit comprises: a first resistor coupled to the charging roller; a second resistor coupled between the first resistor and a potential; and a third resistor coupled between a second potential and a junction of the first and second transistor.

The charging voltage controller of claim 1, further comprising: an A/D converting unit coupled between the controller and the charging roller.

According to the present invention, a method of a charging voltage controller of an image forming apparatus having a charging roller charging a photoconductive medium with a charging voltage, includes supplying first and second test voltages of different levels to the charging roller charging a photoconductive medium, detecting the first and second currents flowing the charging roller when the first and second test voltages are applied to the charging roller, calculating slope data based on a first reference voltage generated from the first current, and also based on the first and second currents, and determining the charging voltage to be applied to the charging roller as a sum of the first reference voltage and a preset offset voltage that corresponds to the slope data.

The supplying of the supply voltage to the high voltage supply comprises: supplying the high voltage supply unit with the first test voltage before supplying the second test voltage to the photoconductive medium.

The first test voltage is greater than the second test voltage.

The first reference voltage is calculated based on an environment factor and the first current.

The environment factors comprise: one or a combination of humidity, temperature, a thickness, and a surface condition of the photoconductive medium.

BRIEF DESCRIPTION OF THE DRAWINGS

These and/or other aspects and advantages of the invention will become apparent and more readily appreciated from the following description of the preferred embodiments taken in conjunction with the accompanying drawings in which.

DETAILED DESCRIPTION OF THE PREFERRED EMBODIMENTS

Figure 1:
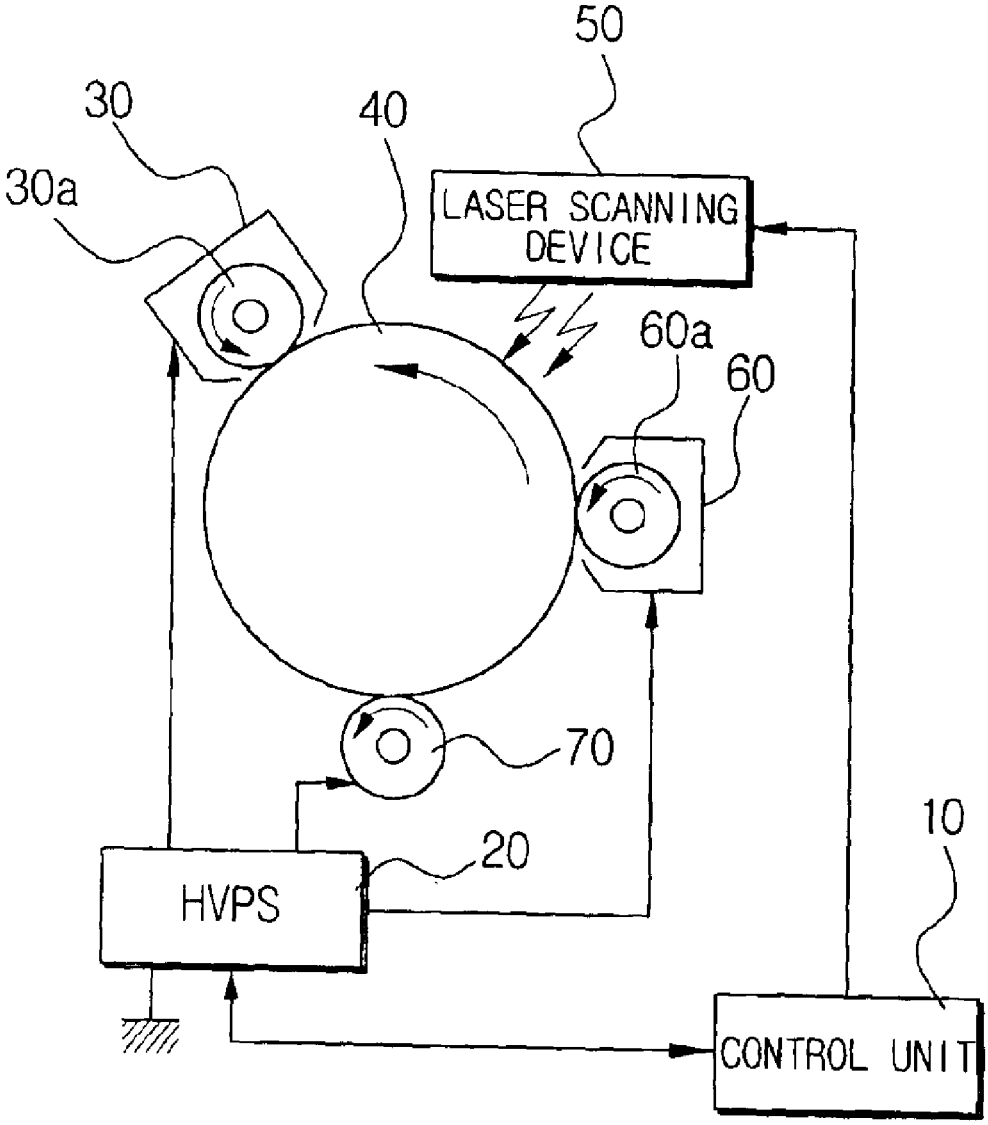
FIG. 1 (PRIOR ART)
FIG. 1 is a schematic cross-sectional view of a charging voltage controller of a conventional image forming apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The following detailed description will present a controller for a charging voltage in an image forming apparatus according to an embodiment of the invention with reference to the accompanying drawings.

Figure 2:
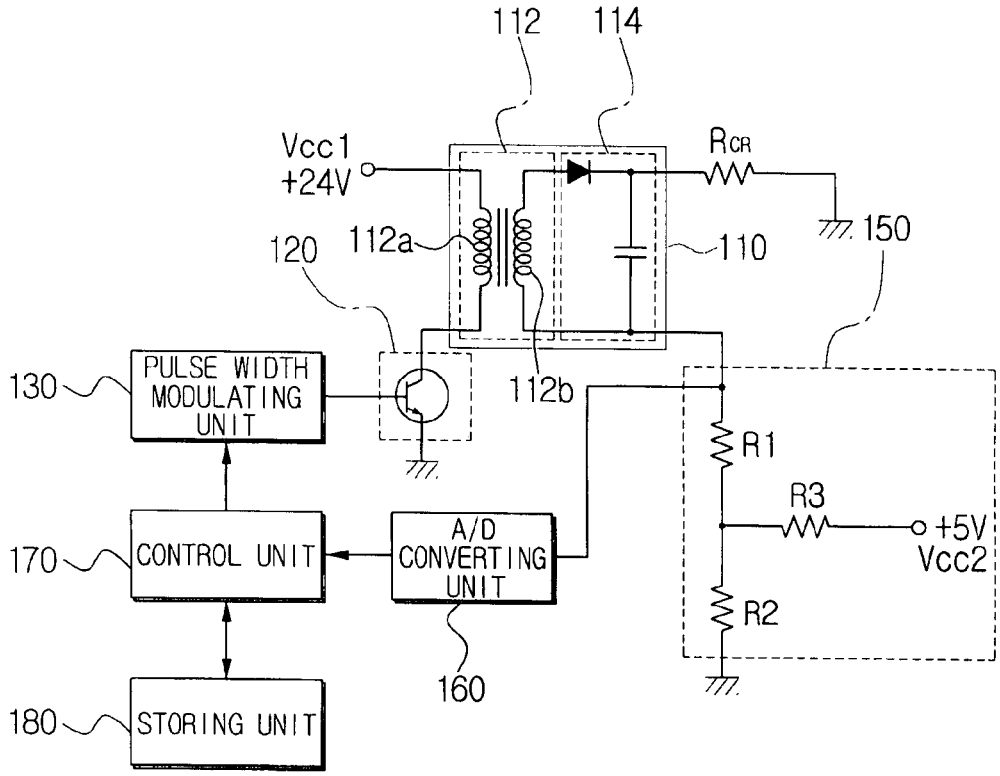
FIG. 2 is a schematic cross-sectional view of a charging voltage controller of an image apparatus according to an embodiment of the present invention.

FIG. 2 is a circuit diagram of a charging voltage controller of an image forming apparatus according to an embodiment of the present invention. Referring to FIG. 2, the charging voltage controller includes a high voltage supply unit 110, a switching unit 120, a pulse width modulating unit 130, a current detecting unit 150, an A/D converting unit 160, a control unit 170, and a storage unit 180.

The high voltage supply unit 110 supplies a predetermined charging voltage to a charging roller (not shown) in accordance with a control of the control unit 170 which will be described later.

The high voltage supply unit 110 includes a transformer 112 and a rectifier 114. The transformer 112 includes a primary winding 112*a* receiving a voltage supply Vcc1 from a power supply unit, and a secondary winding 112*b* electrically coupled with the primary winding 112*a*.

The rectifier 114 rectifies a voltage induced at the secondary winding 112*b* of the transformer 112. The switching unit 120 is connected to switch on/off the voltage supply Vcc1 to the primary winding 112*a* from the power supply providing unit. The switching unit 120 includes a transistor TR used as a switching element.

The pulse width modulating unit 130 controls a duty of on/off timing of the switching unit 120 according to a controlling signal from the control unit 170.

The current detecting unit 150 is connected to the rectifier 114 to detect a current flowing through an effective resistance $R_{CR}$ of the charging roller (not shown) provided with the voltage induced at the secondary winding 112*b* of the transformer 110, and to output a signal in response to the detected current. The signal from the current detecting unit 150 varies depending on the effective resistance $R_{CR}$ of the charging roller.

The current detecting unit 150 includes first and second resistance elements R1 and R2 connected in series to a first output end of the rectifier 114 of which a second output end is connected to the charging roller, and a voltage source supplies a predetermined electrical potential Vcc2 to a connecting point of the first and the second resistance elements R1 and R2. The current detecting unit 150 outputs a voltage drop signal of another connecting point between the first resistance element R1 and the rectifier 114 to the A/D converting unit 160.

The A/D converting unit 160 converts the voltage drop signal corresponding to a current detected at the current detecting unit 150 into a digital signal.

The storage unit 180 stores various programs performing functions of the image forming apparatus and various information controlling the charging voltage controller.

The storage unit 180 stores first and second lookup tables. The first lookup table stores at least one preset environmental factor corresponding to the digital signal input from the A/D converting unit 160 and also stores preset reference voltage data corresponding to the preset environmental factor, and the second lookup table stores slope data calculated from electrical current data of the charging roller which is detected after different test voltages are applied to the charging roller, and the preset offset voltage data corresponding to the slope data. Tables 1 and 2 below show respective examples of the first and second lookup tables stored in the storage unit 180.

TABLE 1

| Environmental factor | Reference voltage |
|---|---|
| 100 or below | −1.45 KV |
| 100~150 | −1.40 KV |
| 150~200 | −1.35 KV |
| 200~255 | −1.30 KV |

TABLE 2

| Slope data | Offset voltage |
|---|---|
| 0.19 | 0 V |
| 0.21 | 15 V |
| 0.23 | 30 V |
| 0.25 | 50 V |

The environmental factor stored in the first look-up table is set to correspond to the digital signal inputted from the A/D converting unit 160, and may be classified into low temperature/humidity (L/L), normal temperature/humidity (N/N), and high temperature/humidity (H/H) according to surrounding conditions, such as temperature and humidity. For example, the environmental factor of 100 or below may be classified as low temperature/humidity (L/L), 100-200 as normal temperature/humidity (N/N), and 200-255 as high temperature/humidity (H/H).

The control unit 170 determines the charging voltage to be applied to the charging roller so that a uniform image can be obtained regardless of a printing environment of the image forming apparatus, the effective resistance $R_{CR}$ of the charging roller, and a thickness of a surface of the photoconductive drum (not shown).

The control unit 170 determines the charging voltage to be applied to the charging roller before a printing operation, and then charges the photoconductive drum with the determined charging voltage supplied to the charging roller. The determining of the charging voltage to be applied to the charging roller will be called a "charging voltage determination mode."

Figure 3:
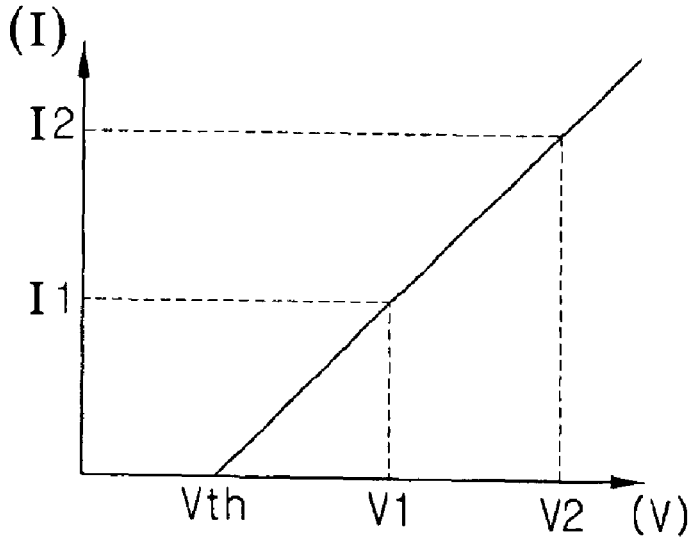
FIG. 3 is a graph explaining a process of determining a charging voltage in the charging voltage controller shown in FIG. 2.

FIG. 3 is a graph explaining a process of determining a charging voltage in the charging voltage controller shown in FIG. 2.

Referring to FIG. 3, V2 and V1 represent a first test voltage and a second test voltage, respectively, and I2 and I1 represent currents flowing through the charging roller in response to the V2 and the V1, respectively.

In the process of determining the charging voltage, the control unit 170 respectively detects the currents flowing through the charging roller in response to the test voltages V1 and V2 applied to the charging roller. Then, the control unit 170 estimates a discharging start voltage Vth at a point where a current is zero, based on the slope data with respect to a change of the currents I1 and I2 in response to the first and second test voltages V1 and V2, and controls the pulse width modulating unit 130 such that another voltage of more than the discharging start voltage Vth can be applied to the charging roller.

More specifically, the control unit 170 controls the pulse width modulating unit 130 such that two test voltages V1 and V2 larger than the discharging start voltage Vth as shown in FIG. 3 are supplied to the charging roller. Then, the control unit 170 calculates the discharging start voltage Vth by detecting the currents I1 and I2 respectively flowing through the effective resistance $R_{CR}$ of the charging roller in response to the applied test voltages V1 and V2.

The control unit 170 may determine the charging voltage to be applied to the charging roller by using the calculated discharging start voltage Vth. That is, the control unit 170 may determine the another voltage larger than the discharging start voltage Vth as the charging voltage. For example, the control unit 170 determines the charging voltage by adding the surface electric potential Vo of the photoconductive drum (not shown) with the discharging start voltage Vth.

Meanwhile, a method of determining the charging voltage according to another embodiment of the present invention determines the charging voltage in accordance with the effective resistance $R_{CR}$ of the charging roller. Environmental factors, such as temperature and humidity, are taken into account because the effective resistance $R_{CR}$ may change due to a change in the environmental factors.

The control unit 170 controls the pulse width modulating unit 130 so that the preset first test voltage V1 is induced through the secondary winding 112*b*, and also controls the duty of the on/off timing of the switching unit 120. Also, the control unit 170 determines the first reference voltage to be applied to the charging roller according to the digital signal provided from the A/D converting unit 160 in response to the first test voltage V1.

When the digital signal is inputted from the A/D converter 160 in correspondence with the electrical current data detected by the current detecting unit 150, the environmental factor corresponding to the input digital signal is obtained with reference to the first lookup table as shown in the table 1, and the control unit 170 determines the voltage data corresponding to the obtained environment factor as the first reference voltage which is to be applied to the charging roller.

For example, if the digital signal 128 is sent from the A/D converting unit 160 in response to the first test voltageV1 of −1.5 KV applied to the charging roller, the control unit 170 selects the environmental factor set for the digital signal 128. If the preset environmental factor for the digital signal 128 is 180, the control unit 170 selects the reference voltage set for the environmental factor 180 using the first look-up table stored in the storage unit 180, and determines that the voltage of −1.35 KV as the first reference voltage which is to be applied to the charging roller.

Also, the control unit 170 controls the pulse width modulating unit 130 so that the second test voltage V2 of −1.2 KV that is different from the first test voltage V1 of −1.5 KV may be induced at the secondary winding 112*b*. The control unit 170 calculates the slope data using a current change based on the current values respectively provided regarding the first test voltage V1 of −1.5 KV and the second test voltage V2 of −1.2 KV, and selects a preset offset voltage based on the calculated slope data. That is, the control unit 170 selects the preset offset voltage corresponding to the calculated slope data with reference to the second look-up table shown in table 2.

The control unit 170 selects the first reference voltage and the preset offset voltage from the first and the second look-up tables stored in the storage unit 180.

The control unit 170 determines the charging voltage to be applied to the charging roller using the first reference voltage and the preset offset voltage. That is, the control unit 170 determines the charging voltage to be applied to the charging roller by adding the preset offset voltage to the first reference voltage.

The control unit 170 controls the pulse width modulating unit 130 so that the determined charging voltage is supplied to the charging roller.

The charging voltage controller of the image forming apparatus according to the present invention is capable of suppressing a change of a surface electric potential of the photoconductive medium occurring due to a change in factors influencing the charging potential, such as changes in environments including temperature and humidity or a resistance change of the charging roller, thereby always maintaining a constant surface potential of the photoconductive medium and obtaining a uniform image quality.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The description of the present invention is intended to be illustrative, and not to limit the scope of the claims. Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A charging voltage controller of an image forming apparatus comprising:

a charging roller charging a photoconductive drum with a predetermined charging voltage;

a high voltage supply unit supplying the predetermined charging voltage to the charging roller;

an electric current detecting unit detecting an electrical current flowing to the charging roller; and a control unit supplying first and second test voltages of different levels to the charging roller, determining a first reference voltage to be applied to the charging roller based on data from the electric current detecting unit outputted in response to the first test voltage, calculating slope data based on the electrical current data detected from the electric current detecting unit in response to the first and second test voltages, and determining the charging voltage to be applied to the charging roller as a sum of the first reference voltage and a preset offset voltage that corresponds to the slope data.

2. The charging voltage controller of claim 1, further comprising:

a storage unit storing a first lookup table and a second lookup table, wherein the first lookup table stores an environmental factor set in correspondence with the data outputted from the electric current detecting unit in response to the first and second test voltages, and the first reference voltage set in correspondence with the environmental factor, and the second lookup table stores offset voltage data set in correspondence with the slope data.

3. The charging voltage controller of claim 1, wherein the controller supplies the high voltage supply unit with the first test voltage before supplying the second test voltage to the photoconductive medium.

4. The charging voltage controller of claim 3, wherein the first test voltage is greater than the second test voltage.

5. The charging voltage controller of claim 2, wherein the environment factors comprise:

one or a combination of humidity, temperature, a thickness, and a surface condition of the photoconductive medium.

6. The charging voltage controller of claim 1, wherein the high voltage supply unit comprises:

a transformer having a primary winding coupled between a potential and the controller; and a secondary winding having a first end coupled to the charging roller and a second end coupled to the current detecting unit; and a rectifying unit rectifying a voltage disposed on the secondary winding of the transformer.

7. The charging voltage controller of claim 1, further comprising:

a pulse width modulating unit coupled between the controller and the primary winding to output a signal having a duty ratio according to a control signal of the controller; and a switching unit coupled between the pulse width modulating unit and the primary winding of the high voltage supply unit to supply the first and second test voltage, and the charging voltage to the high voltage supply unit according to the signal having the duty ratio.

8. The charging voltage controller of claim 1, wherein the current detecting unit comprises:

a first resistor coupled to the charging roller;

a second resistor coupled between the first resistor and a potential; and a third resistor coupled between a second potential and a junction of the first and second resistors.

9. The charging voltage controller of claim 1, further comprising:

an A/D converting unit coupled between the controller and the charging roller.

10. A method of a charging voltage controller of an image forming apparatus having a charging roller charging a photoconductive medium with a charging voltage, comprising:

supplying first and second test voltages of different levels to the charging roller charging a photoconductive medium;

detecting the first and second currents flowing the charging roller when the first and second test voltages are applied to the charging roller;

calculating a first reference voltage generated from the first current and slope data based on the first and second currents; and determining the charging voltage to be applied to the charging roller as a sum of the first reference voltage and a preset offset voltage that corresponds to the slope data.

11. The method of claim 10, wherein the supplying of the supply voltage to the high voltage supply comprises:

supplying the high voltage supply unit with the first test voltage before supplying the second test voltage to the photoconductive medium.

12. The method of claim 11, wherein the first test voltage is greater than the second test voltage.

13. The method of claim 10, wherein the first reference voltage is calculated based on an environment factor and the first current.

14. The method of claim 13, wherein the environment factors comprise:

one or a combination of humidity, temperature, a thickness, and a surface condition of the photoconductive medium.

* * * * *